US012320037B2

(12) United States Patent
Lozano et al.

(10) Patent No.: US 12,320,037 B2
(45) Date of Patent: Jun. 3, 2025

(54) HANDHELD/PORTABLE APPARATUS FOR THE PRODUCTION OF FINE FIBERS

(71) Applicant: BOARD OF REGENTS, THE UNIVERSITY OF TEXAS SYSTEM, Austin, TX (US)

(72) Inventors: Karen Lozano, McAllen, TX (US); Pablo Vidal, McAllen, TX (US); Claudia Cueva, Austin, TX (US)

(73) Assignee: BOARD OF REGENTS, THE UNIVERSITY OF TEXAS SYSTEM, Austin, TX (US)

( * ) Notice: Subject to any disclaimer, the term of this patent is extended or adjusted under 35 U.S.C. 154(b) by 0 days.

(21) Appl. No.: 18/548,636

(22) PCT Filed: Mar. 2, 2022

(86) PCT No.: PCT/US2022/018552
§ 371 (c)(1),
(2) Date: Sep. 1, 2023

(87) PCT Pub. No.: WO2022/187383
PCT Pub. Date: Sep. 9, 2022

(65) Prior Publication Data

US 2024/0052524 A1 Feb. 15, 2024

Related U.S. Application Data

(60) Provisional application No. 63/155,563, filed on Mar. 2, 2021.

(51) Int. Cl.
*D01D 4/06* (2006.01)
*D01D 1/06* (2006.01)

(52) U.S. Cl.
CPC ..... *D01D 4/06* (2013.01); *D01D 1/06* (2013.01)

(58) Field of Classification Search
CPC ..... D01D 1/06; D01D 4/06
See application file for complete search history.

(56) References Cited

U.S. PATENT DOCUMENTS 2,336,743 A 10/1941 Manning
2,609,566 A 9/1952 Slayter et al.
(Continued)

FOREIGN PATENT DOCUMENTS

CN 1472373 2/2004
CN 101709534 A 5/2010
(Continued)

OTHER PUBLICATIONS

International Search Report and Written Opinion for International Application No. PCT/IB2018/056854, date mailed Jan. 17, 2019.
(Continued)

*Primary Examiner* — Emmanuel S Luk
(74) *Attorney, Agent, or Firm* — Kowert, Hood, Munyon, Rankin & Goetzel PC; Gareth M. Sampson

(57) ABSTRACT

Described herein are portable apparatuses and methods of creating fibers such as microfibers and nanofibers. The methods described herein employ accelerated air to impact fine jets created from polymer solutions going through individual tracks or channels within an exit die. Apparatuses that may be used to create fibers are also described.

19 Claims, 4 Drawing Sheets

(56) References Cited

U.S. PATENT DOCUMENTS 3,245,112 A 4/1966 Williamson
3,347,469 A * 10/1967 Ross ..... B05B 7/144 118/631
3,388,194 A 6/1968 Vinicki
3,428,724 A 2/1969 Billheimer
3,504,861 A * 4/1970 McNinch, Jr. ..... B29C 41/365 239/300
3,529,934 A 9/1970 Shindo
3,551,178 A * 12/1970 Chmelar ..... B05B 7/145 118/640
3,551,557 A 12/1970 Garcia
3,740,260 A * 6/1973 Winn ..... B29B 7/7438 239/8
3,920,362 A 11/1975 Bradt
4,043,331 A 8/1977 Martin et al.
4,070,446 A 1/1978 Horikiri et al.
4,113,666 A 9/1978 Sano et al.
4,246,294 A * 1/1981 Jordan ..... B05B 5/032 427/206
4,282,637 A * 8/1981 Mosseri ..... D02G 1/161 28/273
4,285,318 A * 8/1981 Yoneda ..... F02D 21/08 123/568.29
4,323,524 A 4/1982 Snowden
4,323,525 A 4/1982 Bornat
4,374,074 A 2/1983 Ueda et al.
4,526,525 A 7/1985 Oiso et al.
4,790,736 A 12/1988 Keuchel
4,793,782 A 12/1988 Sullivan
4,872,821 A 10/1989 Weiss
5,066,430 A 11/1991 Matthews
5,165,940 A 11/1992 Windley
5,190,217 A * 3/1993 Black ..... B05B 7/1495 239/526
5,242,633 A 9/1993 Rook et al.
5,326,241 A 7/1994 Rook et al.
5,344,297 A 9/1994 Hills
5,419,794 A 5/1995 Hauber et al.
5,441,754 A 8/1995 Evans, Sr.
5,447,423 A 9/1995 Fuisz et al.
5,458,823 A 10/1995 Perkins et al.
5,460,498 A 10/1995 Steel et al.
5,480,598 A 1/1996 Gentile et al.
5,556,589 A 9/1996 Sibal
5,582,841 A 12/1996 Watton et al.
5,622,671 A 4/1997 Pellegrin et al.
5,667,814 A 9/1997 Shah
5,698,146 A 12/1997 Schippers et al.
5,718,716 A 2/1998 Goddard et al.
5,785,996 A 7/1998 Snyder
5,911,942 A 6/1999 Fofonoff et al.
5,939,120 A 8/1999 Bogue et al.
5,948,334 A 9/1999 Takeuchi et al.
5,972,497 A 10/1999 Hirwe et al.
5,985,193 A 11/1999 Harrington et al.
6,110,590 A 8/2000 Zarkoob et al.
6,159,597 A 12/2000 Meerman et al.
6,216,430 B1 4/2001 Oppermann
6,221,487 B1 4/2001 Luo et al.
6,235,392 B1 5/2001 Luo et al.
6,382,526 B1 5/2002 Reneker et al.
6,511,930 B1 1/2003 Luo et al.
6,524,514 B1 2/2003 Volokitin et al.
6,548,166 B2 4/2003 Figuly et al.
6,596,033 B1 7/2003 Luo et al.
6,622,948 B1 * 9/2003 Haas ..... B05B 5/032 239/708
6,682,677 B2 1/2004 Lobovsky et al.
6,713,011 B2 3/2004 Chu et al.
6,753,454 B1 6/2004 Smith et al.
6,783,708 B2 8/2004 Konishi
6,787,090 B2 9/2004 Dalton et al.
6,800,226 B1 10/2004 Gerking
6,843,902 B1 1/2005 Penner et al.
6,852,410 B2 2/2005 Veedu et al.
6,858,168 B1 2/2005 Vollrath et al.
6,872,311 B2 3/2005 Koslow
6,904,745 B2 6/2005 Badiali et al.
7,018,188 B2 3/2006 James et al.
7,032,664 B2 4/2006 Lord et al.
7,036,592 B2 5/2006 Nguyen et al.
7,056,455 B2 6/2006 Matyjaszewski et al.
7,056,849 B2 6/2006 Wan et al.
7,067,444 B2 6/2006 Luo et al.
7,118,698 B2 10/2006 Armantrout et al.
7,127,294 B1 10/2006 Wang et al.
7,134,857 B2 11/2006 Andrady et al.
7,146,792 B2 12/2006 Badiali et al.
7,169,374 B2 1/2007 Siochi et al.
7,186,474 B2 3/2007 Jang
7,208,546 B2 4/2007 Rajagopalan et al.
7,288,306 B2 10/2007 Kersey
7,316,723 B2 1/2008 Chung et al.
7,332,050 B2 2/2008 Kim
7,488,387 B2 * 2/2009 Kuo ..... B05B 7/145 239/708
7,655,175 B2 2/2010 Michael et al.
7,666,343 B2 2/2010 Johnson et al.
7,691,168 B2 4/2010 Fox et al.
7,763,228 B2 7/2010 Oya et al.
7,857,608 B2 12/2010 Fabbricante et al.
7,901,195 B2 3/2011 Fabbricante et al.
8,110,136 B2 2/2012 Takahashi et al.
8,163,227 B2 4/2012 Sumida et al.
8,231,378 B2 7/2012 Lozano et al.
8,277,711 B2 10/2012 Huang et al.
8,721,319 B2 5/2014 Lozano et al.
8,828,294 B2 9/2014 Lozano et al.
9,228,276 B2 1/2016 Barton et al.
9,988,271 B2 6/2018 Lozano et al.
10,087,554 B2 10/2018 Lozano et al.
10,422,054 B2 9/2019 Lozano et al.
10,492,387 B1 * 12/2019 Davison ..... A01G 31/02
10,654,009 B1 * 5/2020 Yelvington ..... B01J 8/386
10,952,517 B2 * 3/2021 Fukuda ..... D01D 13/02
11,207,510 B2 * 12/2021 Wright ..... D01D 5/18
2001/0003148 A1 6/2001 Coffee
2001/0033037 A1 10/2001 Nitschke et al.
2002/0035354 A1 3/2002 Mirle et al.
2002/0106509 A1 8/2002 Figuly et al.
2002/0121526 A1 * 9/2002 Debalme ..... F01N 1/24 141/70
2004/0076661 A1 4/2004 Chu et al.
2004/0086591 A1 * 5/2004 Vollrath ..... D01D 4/02 425/149
2004/0096533 A1 5/2004 Dubson et al.
2004/0241216 A1 12/2004 Klun et al.
2005/0054830 A1 3/2005 Islam et al.
2005/0081506 A1 6/2005 Badiali et al.
2005/0136253 A1 6/2005 Michael et al.
2005/0163955 A1 7/2005 Schaefer et al.
2006/0024399 A1 2/2006 Chang et al.
2006/0048355 A1 3/2006 Kim
2006/0049542 A1 3/2006 Chu et al.
2006/0091582 A1 5/2006 James et al.
2006/0165836 A1 * 7/2006 Vollrath ..... D01D 4/02 425/382 R
2006/0228435 A1 10/2006 Andrady et al.
2007/0023958 A1 2/2007 LaVietes et al.
2007/0057414 A1 3/2007 Hartge
2007/0184079 A1 8/2007 Gabbay
2008/0023888 A1 1/2008 Brang et al.
2008/0029617 A1 2/2008 Marshall et al.
2008/0038979 A1 * 2/2008 Weigel ..... D04H 3/11 264/172.16
2008/0050304 A1 2/2008 Oya et al.
2008/0113214 A1 5/2008 Davis
2008/0136054 A1 6/2008 Fabbricante et al.
2008/0211121 A1 9/2008 Lai et al.
2008/0242171 A1 10/2008 Huang et al.
2009/0020921 A1 1/2009 Cakmak et al.
2009/0042475 A1 2/2009 Pourdeyhimi
2009/0102100 A1 4/2009 Hellring et al.

(56) References Cited

U.S. PATENT DOCUMENTS

| | | | | |
|---|---|---|---|---|
| 2009/0142581 | A1 | 6/2009 | Heintz et al. | |
| 2009/0155326 | A1 | 6/2009 | Mack et al. | |
| 2009/0160099 | A1 | 6/2009 | Huang | |
| 2009/0162468 | A1 | 6/2009 | Barinov et al. | |
| 2009/0232920 | A1 | 9/2009 | Lozano et al. | |
| 2009/0269429 | A1 | 10/2009 | Lozano et al. | |
| 2009/0280207 | A1 | 11/2009 | Lozano et al. | |
| 2009/0280325 | A1 | 11/2009 | Lozano et al. | |
| 2010/0168808 | A1 | 7/2010 | Citron | |
| 2010/0215790 | A1* | 8/2010 | Reneker | D01D 1/09 425/162 |
| 2010/0233115 | A1 | 9/2010 | Patel et al. | |
| 2011/0147301 | A1 | 6/2011 | Johnson et al. | |
| 2011/0156319 | A1 | 6/2011 | Kurokawa et al. | |
| 2012/0077406 | A1 | 3/2012 | Scrivens et al. | |
| 2012/0082711 | A1 | 4/2012 | Goranov | |
| 2012/0135448 | A1 | 5/2012 | Parker et al. | |
| 2012/0292795 | A1 | 11/2012 | Peno | |
| 2012/0292796 | A1 | 11/2012 | Peno | |
| 2012/0292810 | A1 | 11/2012 | Peno | |
| 2012/0294966 | A1 | 11/2012 | Peno | |
| 2012/0295021 | A1 | 11/2012 | Peno | |
| 2012/0304613 | A1 | 12/2012 | Peno | |
| 2013/0149367 | A1 | 6/2013 | Messier et al. | |
| 2013/0214442 | A1 | 8/2013 | Naskar | |
| 2013/0299748 | A1 | 11/2013 | Kazaryan et al. | |
| 2013/0300012 | A1* | 11/2013 | Padron | D01D 5/18 425/72.1 |
| 2014/0005470 | A1 | 1/2014 | Soletti et al. | |
| 2014/0025179 | A1 | 2/2014 | Kay et al. | |
| 2014/0159263 | A1* | 6/2014 | Lozano | D01D 5/18 425/8 |
| 2015/0071572 | A1* | 3/2015 | Dreher | B31B 70/74 383/105 |
| 2015/0184317 | A1 | 7/2015 | Lozano et al. | |
| 2015/0201732 | A1* | 7/2015 | Kakon | A45D 33/02 222/333 |
| 2015/0354094 | A1 | 12/2015 | Parker et al. | |
| 2015/0374878 | A1 | 12/2015 | Carter et al. | |
| 2016/0015098 | A1 | 1/2016 | Conlon | |
| 2016/0053172 | A1 | 2/2016 | Mori | |
| 2017/0239094 | A1* | 8/2017 | Dubson | A61F 13/00017 |
| 2018/0094363 | A1* | 4/2018 | Ikegaya | D04H 3/16 |
| 2019/0242031 | A1* | 8/2019 | Bidhar | D01D 5/0092 |
| 2019/0280561 | A1* | 9/2019 | Abramov | H02K 7/183 |
| 2019/0292685 | A1* | 9/2019 | Fong | B29C 48/142 |
| 2020/0030222 | A1* | 1/2020 | Hirano | A61K 8/046 |
| 2020/0173057 | A1* | 6/2020 | Ikegaya | D01D 4/02 |
| 2020/0240059 | A1 | 7/2020 | Baharlou et al. | |
| 2023/0287601 | A1* | 9/2023 | Sugawara | B05B 12/004 118/708 |

FOREIGN PATENT DOCUMENTS

| | | |
|---|---|---|
| CN | 101805942 | 8/2010 |
| CN | 101922060 | 12/2010 |
| CN | 102094254 | 6/2011 |
| CN | 209584428 | 3/2019 |
| DE | 19621231 | 7/1997 |
| EP | 0 003 908 | 9/1979 |
| EP | 0 306 033 | 3/1989 |
| EP | 0 472 067 | 2/1992 |
| EP | 0 709 035 | 5/1996 |
| EP | 1 673 493 | 7/2009 |
| JP | 06287355 | 10/1994 |
| JP | 2001073222 | 3/2001 |
| JP | 2009270221 | 11/2009 |
| KR | 20040052685 | 6/2004 |
| WO | 03/042436 | 5/2003 |
| WO | 2004/056716 | 7/2004 |
| WO | 2005024101 | 3/2005 |
| WO | 2005/042813 | 5/2005 |
| WO | 2009/079523 | 6/2006 |
| WO | 2008/077349 | 7/2008 |
| WO | 2008/121338 | 10/2008 |
| WO | 2010/132636 | 11/2010 |
| WO | 2012/068402 | 5/2012 |

OTHER PUBLICATIONS

M. Noruzi, Electrospun nanofibres in agriculture and the food industry: a review, J. Sci. Food Agric. 96 (2016) 4663-4678. https://doi.org/10.1002/jsfa.7737.

B. Ghorani, N. Tucker, Fundamentals of electrospinning as a novel delivery vehicle for bioactive compounds in food nanotechnology, Food Hydrocoll. 51 (2015) 227-240. https://doi.org/10.1016/j.foodhyd.2015.05.024.

T. Senthil Muthu Kumar, K. Senthil Kumar, N. Rajini, S. Siengchin, N. Ayrilmis, A. Varada Rajulu, A comprehensive review of electrospun nanofibers: Food and packaging perspective, Compos. Part B Eng. 175 (2019) 107074. https://doi.org/10.1016/j.compositesb.2019.107074.

K.D. Mattice, A.G. Marangoni, Comparing methods to produce fibrous material from zein, Food Res. Int. 128 (2020) 108804. https://doi.org/10.1016/j.foodres.2019.108804.

M.L.R. Carlsson, S. Kanagarajan, L. Bülow, L.H. Zhu, Plant based production of myoglobin—a novel source of the muscle heme-protein, Sci. Rep. 10 (2020) 1-10. https://doi.org/10.1038/s41598-020-57565-y.

C.P. Barnes, M.J. Smith, G.L. Bowlin, S.A. Sell, T. Tang, J.A. Matthews, D.G. Simpson, J.C. Nimtz, Feasibility of Electrospinning the Globular Proteins Hemoglobin and Myoglobin, J. Eng. Fiber. Fabr. 1 (2006) 155892500600100. https://doi.org/10.1177/155892500600100202.

A. Kishimura, A. Koide, K. Osada, Y. Yamasaki, K. Kataoka, Encapsulation of myoglobin in PEGylated polyion complex vesicles made from a pair of oppositely charged block ionomers: A physiologically available oxygen carrier, Angew. Chemie—Int. Ed. 46 (2007) 6085-6088. https://doi.org/10.1002/anie.200701776.

European Extended Search Report and European Search Opinion issued in EP18854957.0 mailed Apr. 12, 2021.

International Search Report and Written Opinion for International Application No. PCT/US2020/018725, issued May 11, 2020.

International Preliminary Report on Patentability for International Application No. PCT/US2022/018552, mailed Sep. 14, 2023.

International Search Report and Written Opinion for International Application No. PCT/US2022/018552, date mailed May 18, 2022, 7 pgs.

Extended European Search Report for European Patent Application No. 22763990.3, mailed Jul. 15, 2024, 6 pgs.

Aquilano et al. "{1 0 0} and {1 1 1} forms of the NaCl crystals coexisting in growth from pure aqueous solution" Journal of Crystal Growth (2009) 311(2):399-403.

Assouline et al. "Nucleation ability of multiwalled carbon nanotubes in polypropylene composites" Journal of Polymer Science Part B: Polymer Physics (2003) 41(5), 520-527.

Badrossamay et al. "Nanofiber Assembly by Rotary Jet-Spinning" Nano Lett. 2010, 10, 2257-2261.

Baji et al "Electrospinning of polymer nanofibers: effects on oriented morphology, structures and tensile properties" Composites Science and Technology (2010) 70(5), 703-718.

Champion et al. "Making Micro- and Nanoparticles of Complex Shapes" PNAS, 2007, 104:11901-11904.

Cho et al. "Structural properties and superhydrophobicity of electrospun polypropylene fibers from solution and melt", Polymer (2010), 51(25), 6005-6012.

"Cotton Candy Express" Available at http://cottoncandyexpress.com/resimachine, Jun. 8, 2009.

Cui et al. "Facile synthesis of core/shell-structured Sn/onion-like carbon nanocapsules as high-performance anode material for lithium-ion batteries" Materials Letters (2015) 143: p. 35-37.

Dabirian et al. "A comparative study of jet formation and nanofiber alignment in electrospinning and electrocentrifugal spinning systems" Journal of Electrostatics (2011) 69(6): p. 540-546.

Dauner "Centrifuge Spinning—An Economic Alternative to Electrospinning" Nano-Cluster Bodensee, NanoEurope 2006, Sep. 14, 2006.

(56) References Cited

OTHER PUBLICATIONS

Foster et al. "Centrifugally Spun Polyhydroxybutyrate Fibres: Accelerated Hydrolytic Degredation Studies" Polymer Degradation and Stability, 2005, 87(1), 1-10. (Abstract).
Greensfelder "Nanofibers Created in Orderly Fashion" UC Berkeley Press Release, Jun. 1, 2009.
Ji et al. "Recent developments in nanostructured anode materials for rechargeable lithium-ion batteries" Energy & Environmental Science (2011) 4(8): p. 2682-2699.
Jiang et al. "Centrifugally-spun tin-containing carbon nanofibers as anode material for lithium-ion batteries" Journal of Materials Science (2015) 50(3): p. 1094-1102.
Kamal et al. "Synthesis and catalytic properties of silver nanoparticles supported on porous cellulose acetate sheets and wet-spun fibers." Carbohydrate Polymers (2017) 157, 294-302.
Koczkur et al. "Polyvinylpyrrolidone (PVP) in nanoparticle synthesis" Dalton Transactions (2015) 44:41, 17883-17905.
Lee et al. "Influence of a mixing solvent with tetrahydrofuran and N, N-dimethylformamide on electrospun poly (vinylchloride) nonwoven mats" Journal of Polymer Science Part B: Polymer Physics (2002), 40(19), 2259-2268.
Li et al. "Carbon encapsulated ultrasmall SnO2 nanoparticles anchoring on graphene/TiO2 nanoscrolls for lithium storage" Electrochimica Acta (2014) 147(0): p. 40-46.
Liu et al. ""Preparation of Nanocrystalline Titanium Dioxide Fibers Using Sol-gel Method and Centrifugal Spinning" J Sol-Gel Sci Technol (2013) 65:443-451."
Mellado et al. "A simple model for nanofiber formation by rotary jet-spinning" Applied Physics Letters (2011) 99, 203107.
"Nonwovens Interactive", Jun. 8, 2009.
Patel et al. "Novel Preparation Method of Silicon Carbide Nanofibers by Use of Polymer Blend and Melt Spinning Techniques" Journal of Ceramic Society of Japan (2004) 112:S901-S903.
Quintero et al. "Rapid Production of Ultralong Amorphous Ceramic Nanofibers by Laser Spinning" App. Physics Let (2007) 90:153109.
Rein et al. "Electrospinning of ultrahigh-molecularweight polyethylene nanofibers", Journal of Polymer Science: Part B: Polymer Physics (2007) 45(7), 766-773.
Rodriguez et al. "Preparation of Electrospun Chitosa-PEO Fibers" Bioengineering Conference, 2006, Proceedings of the IEEE 32nd Annual Northeast, 87-88, Apr. 2006.
Scheffler et al. "Electrospun teflon AF fibers for superhydrophobic membranes" Journal of Materials Research (2010) 25(8), 1595-1600.
Shen et al. "Tin nanoparticle-loaded porous carbon nanofiber composite anodes for high current lithium-ion batteries" Journal of Power Sources (2015) 278: p. 660-667.
Tran et al. "Electrospun SnO2 and TiO2 Composite Nanofibers for Lithium Ion Batteries" Electrochimica Acta (2014) 117(0): p. 68-75.
Tsuji et al. "Rapid transformation from spherical nanoparticles, nanorods, cubes, or bipyramids to triangular prisms of silver with PVP, citrate, and H2O2" Langmuir (2012) 28:24, 8845-8861.
Warner et al. "Cost Effective Nanofiber Formation: Melt Electrospinning" National Textile Center Annual Report, Nov. 2005.
Weitz et al. "Polymer Nanofibers Via Nozzle-Free Centrifugal Spinning" Nano Letters (2008), 8:1187-1191.
Xia et al. "The effects of electrospinning parameters on coaxial Sn/C nanofibers: Morphology and lithium storage performance" Electrochimica Acta (2014) 121(0): p. 345-351.
Zheng et al. "Controlled Crystallization of Sodium Chloride Nanocrystals in Microdroplets Produced by Electrospray from an Ultra-Dilute Solution" European Journal of Inorganic Chemistry (2016), No. 12, 1860-1865.
Zhou et al. "Three-jet electrospinning using a flat spinneret" J. Mater Sci. (2009), 44, 5501-5508.
Zhong et al. "Nanostructued core-shell Sn nanowires @ CNTs with controllable thickness of CNT shells for lithium ion battery" Applied Surface Science (2015) 332: p. 192-197.
"Manufacturing: Synthetic and Cellulosic Fiber Formation Technology" www.fibersource.com/f-tutor/techpag.htm Apr. 7, 2011.
Li et al. "Green and facile synthesis of fibrous Ag/cotton composites and their catalytic properties for 4-hitrophenol reduction." Applied Surface Science (2017) 426, 160, 168.
Teo et al. "A Review on Electrospinning Design and Nanofiber Assemblies" Nanotechnology, (2006) 17: R89-R106.
M. Nieuwland, P. Geerdink, P. Brier, P. Van Den Eijnden, J.T.M.M. Henket, M.L.P. Langelaan, N. Stroeks, H.C. Van Deventer, A.H. Martin, Reprint of "food-grade electrospinning of proteins," Innov. Food Sci. Emerg. Technol. 24 (2014) 138-144. https://doi.org/10.1016/j.ifset.2014.07.006.
Y. Dror, T. Ziv, V. Makarov, H. Wolf, A. Admon, E. Zussman, Nanofibers made of globular proteins, Biomacromolecules. 9 (2008) 2749-2754. https://doi.org/10.1021/bm8005243.
Ajalloueian et al., "Emulsion electrospinning as an approach to fabricate PLGS/Chitosan Nanofibers for Biomedical applications" https://pubmed.ncbi.nlm.nih.gov/24689041/, 13 pgs.
Nooshin Nikmaram et al, Royal Society of Chemistry "Emulsion-based systems for fabrication of electrospun nanofibers: food, pharmaceutical and biomedical applications", https://pubs.rsc.org/en/content/articlehtml/2017/ra/c7ra00179g, 14 pgs.
G.T.V. Prabu et al, Scientific Reports natureresearch, "A Novel Profled Multi-Pin Electrospinning System for Nanofber Production and Encapsulation of Nanoparticles into Nanofbers" https://www.nature.com/articles/s41598-020-60752-6.pdf, 11 pgs.
Global Dossier Translation of JP06287355, https://globaldossier.uspto.gov/#/details/JP/7681293/A/129652, printed Feb. 23, 2023. (Year: 2023).
Wang et al. "Controllable fabrication and properties of polypropylene nanofibers" Polymer Engineering and Science (2007) 47(11), 1865-1872.
Fang et al. "Needleless Melt-Electrospinning of Polypropylene Nanofibers" Journal of Nanomaterials, (2012) 1-9.
Watanabe "Effect of organic solvent on morphology and mechanical properties of electrospun syndiotactic polypropylene nanofibers" Polymer Bulletin (2011) 67(9), 2025-2033.
Watanabe et al. "Development of Polypropylene Nanofiber Production System" Polymer Reviews (2011) 51(3), 288-308.
Raghaven et al. "Fabrication of Melt Spun Polypropylene Nanofibers by ForcespinningTM" (2013) Journal of Engineered Fibers and Fabrics vol. 8, Issue 1, Mar. 2013.
Ondarcuhu et al. "Drawing a single nanofibre over hundreds of microns", Europhysics Letters (1998), 42(2), 215-220.
Feng et al. "Super-hydrophobic surface of aligned polyacrylonitrile nanofibers" Angewandte Chemie (International ed. in English) (2002), 41(7), 1221-3.
Martin "Membrane-Based Synthesis of Nanomaterials", Chemistry of Materials (1996) 8(8), 1739-1746.
Ma et al. "Synthetic nano-scale fibrous extracellular matrix", Journal of Biomedical Materials Research (1999) 46(1), 60-72.
Liu et al."Polystyrene-block-poly (2-cinnamoylethyl methacrylate) nanofibers—preparation, characterization, and liquid crystalline properties" Chemistry—A European Journal (1999), 5(9), 2740-2749.
Whitesides et al."Self-assembly at all scales", Science (New York, N.Y.) (2002), 295(5564), 2418-21.
Deitzel et al. "Controlled deposition of electrospun poly (ethylene oxide) fibers", Polymer, (2001) 42(19), 8163-8170.
Doshi et al. "Electrospinning process and applications of electrospun fibers" Journal of Electrostatics (1995), 35 (2&3), 51-60.
Subbiah et al. "Electrospinning of nanofibers" Journal of Applied Polymer Science (2005) 96(2), 557-569.
Ellison et al. "Melt blown nanofibers: Fiber diameter distributions and onset of fiber breakup" Polymer (2007) 48 (11), 3306-3316.
Theron et al. "Multiple jets in electrospinning: experiment and modeling", Polymer (2005), 46(9), 2889-2899.
Tomaszewski et al. "Investigation of electrospinning with the use of a multi-jet electrospinning head" Fibres & Textiles in Eastern Europe (2005) 13(4), 22-26.
Reneker et al. "Nanofiber garlands of polycarpolactone by electrospinning" Polymer (2002) 43(25), 6785-6794.
Han et al. "Superhydrophobic and oleophobic fibers by coaxial electrospinning" Langmuir (2009), 25(16), 9454-9462.

(56) References Cited

OTHER PUBLICATIONS

Xiong et al."Fabrication of ultrafine fibrous polytetrafluoroethylene porous membrane by electrospinning" Journal of Materials Research (2009), 24(9), 2755-2761.
Dorset et al."Isotactic polypropylene, β-phase: a study in frustration" Polymer (1998), 39(25), 6331-6337.
Garbarczyk et al. "Polymorphism of isotactic polypropylene in presence of additives, in blends and in composites" Journal of Macromolecular Science, Part B—Physics (2002), 41 (4-6), 1267-1278.
Wang et al. "Solution-electrospun isotactic polypropylene fibers: processing and microstructure development during stepwise annealing" Macromolecules (2010), 43(21), 9022-9029.
Tan et al."Meltblown fibers: Influence of viscosity and elasticity on diameter distribution" J. Non-Newtonian Fluids Mechanics (2010), 165(15-16), 892-900.
Rangkupan et al. "Electrospinning process of molten polypropylene in vacuum" Journal of Metals, Materials and Minerals (2003) 12(2), 81-87.
Lyons et al. "Meltelectrospinning part I: processing parameters and geometric properties" Polymer (2004) 45, 7597-7603.
Zhmayev et al. "Nanofibers from gas-assisted polymer melt electrospinning", Polymer (2010), 51(18), 4140-4144.
Meille et al. "Structure of β-isotactic polypropylene: a long-standing structural puzzle" Macromolecules (1994) 27 (9), 2615-2622.

* cited by examiner

HANDHELD/PORTABLE APPARATUS FOR THE PRODUCTION OF FINE FIBERS

BACKGROUND OF THE INVENTION

This application is a U.S. National Stage filing of International Application No. PCT/US2022/018552, filed Mar. 2, 2022, titled "HANDHELD/PORTABLE APPARATUS FOR THE PRODUCTION OF FINE FIBERS", which claims the benefit of priority to U.S. Provisional Application No. 63/155,563, filed on Mar. 2, 2021. All the aforementioned applications are incorporated herein by reference in their entireties.

1. Field of the Invention

The disclosed embodiments generally relate to the field of fiber production. Specific embodiments relate to the production of fibers of micron, sub-micron and nano size diameters using a hand held/portable device, where the production is based on the foundation of melt/solution blown spinning.

2. Description of the Relevant Art

Fibers having small diameters (e.g., micrometer ("micron") to nanometer ("nano")) are useful in a variety of fields from the clothing industry to military applications. For example, in the biomedical field, there is a strong interest in developing structures based on nanofibers (NFs) that provide scaffolding for tissue growth to effectively support living cells and as agents in wound care. In wound care the nanofibers may act as agents for inducing hemostasis, protecting against infection, or accelerating the healing process while offering conformability (e.g., ability to adapt to 3D intricate sections). In the textile field, there is a strong interest in nanofibers because the nanofibers have a high surface area per unit mass that provides light, but highly wear resistant, garments. Many potential applications for small-diameter fibers are being developed as the ability to manufacture and control their chemical and physical properties improves.

Current NF making technologies focus primarily on electrospinning and Forcespinning™. Several attempts have been made to create handheld/portable devices using these technologies. Serious disadvantages, however, are still present, such as: need for high electric fields, low yield, time consuming in electrospinning, and parts rotating at high speeds (Forcespinning™).

It is known in fiber manufacturing that the electrospinning process can produce micro and nano fibers of various materials. The process of electrospinning uses an electrical charge to produce fibers from a liquid. The liquid may be a solution of a material in a suitable solvent, or a melt of the material. Electrospinning requires the use of high voltage to draw out the fibers and is limited to materials that can obtain an electrical charge.

Centrifugal spinning is a method by which fibers are also produced without the use of an electric field. In centrifugal spinning, material is ejected through one or more orifices of a rapidly spinning spinneret to produce fibers. The size and or shape of the orifice that the material is ejected from controls the size of the fibers produced. Using centrifugal spinning, microfibers and/or nanofibers may be produced.

BRIEF DESCRIPTION OF THE DRAWINGS

Advantages of the present invention will become apparent to those skilled in the art with the benefit of the following detailed description of embodiments and upon reference to the accompanying drawings in which.

Figure 1:
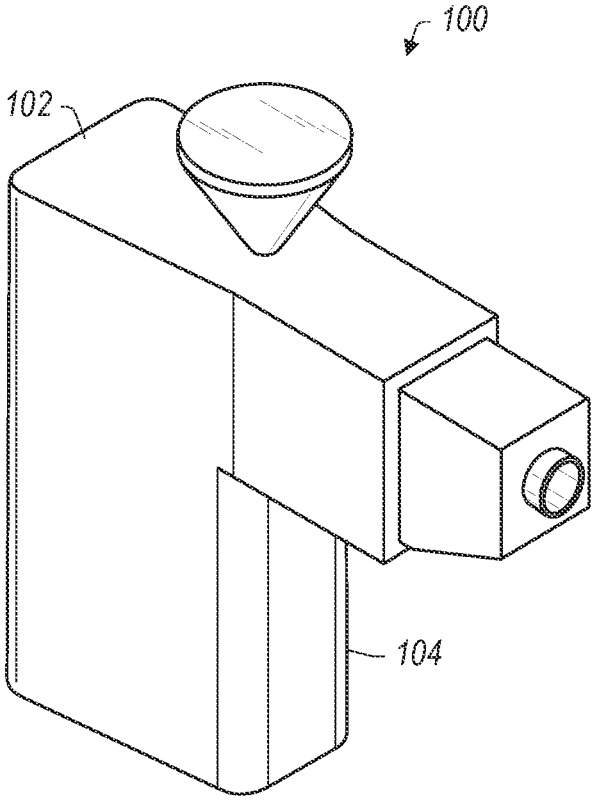
FIG. 1 depicts a schematic diagram of an embodiment of fiber producing system.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

It is to be understood the present invention is not limited to particular devices or methods, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected.

The examples set forth herein are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Embodiments described herein implement melt/solution blow spinning fabrication methods in the production of microfibers. Melt/solution blow spinning fabrication methods include using two parallel concentric fluid streams: a polymer melt or solution and a pressurized gas that flows around the polymer solution. Large air compressors, or pressurized gas are used to be able to thin the fibers. Solution and melt blown processes have been proven reliable and cost effective for micron size fibers. For nanofibers (NFs) though, the process consumes large amount of heated gas in the case of melt blown or atmospheric temperature for solution processes. The energy consumption depends on the polymer characteristics but it may be large and not feasible for scale up if nanofibers are desired. In the case of micron size fibers, the air consumption is 40-100 times as much air by weight as the polymer flow rate in order to form the fiber at high speeds. For example, for a polypropylene 3 μm size fiber, with a polymer flow rate of 0.2 gr/min/hole, the spinning speed is calculated to be 31,000 m/min (about Mach 1.5) and most of this energy is wasted. Reduction of fiber diameter will considerably increase needed speeds. For instance, studies have shown that Mach 3 are required to make nanofibers, which is basically an airplane turbine for this operation. Hand held systems for microfibers have also been shown where a pressurized container (such as a pressurized canister) is used. In these hand held systems, the polymer solution is pressurized and exits as large diameter fibers through a regular nozzle. This process may also be used with an air brush (like for painting) connected to an air compressor.

The present inventors have recognized that a system that is hand held but does not require an air compressor, pressurized gas, or CO2 cartridges may be advantageous and overcome the above-described issues. In embodiments disclosed herein, the present inventors have designed a system that includes a combination of nozzles to ensure proper functionality of converting high pressure to fast air velocity along with exit nozzles to further decrease the size of the fiber. The nozzle design may provide optimal pressure ratios (outlet/inlet pressure) while minimizing loss of pressure due to friction with the nozzle walls.

Described herein are apparatuses and methods of creating fibers, such as microfibers and nanofibers. The methods discussed herein employ blow molding techniques to transform material into fibers. Apparatuses that may be used to create fibers are also described.

FIG. 1 depicts a schematic diagram of an embodiment of fiber producing system 100. Fiber producing system 100 includes the design of the portable system (e.g., housing 102). The housing 102 may have a size and shape that allows for a portable system. Housing 102 can be shaped as it fits ergonomic designs, for example, a shape similar to a hair dryer or a water gun toy. In an embodiment, housing 102 includes handle 104, which may be positioned to allow a user to hold the fiber producing system in a manner such that the fiber producing system can be aimed in the direction where fibers are needed. In various embodiments, handle 104 includes an on/off switch.

Figure 2:
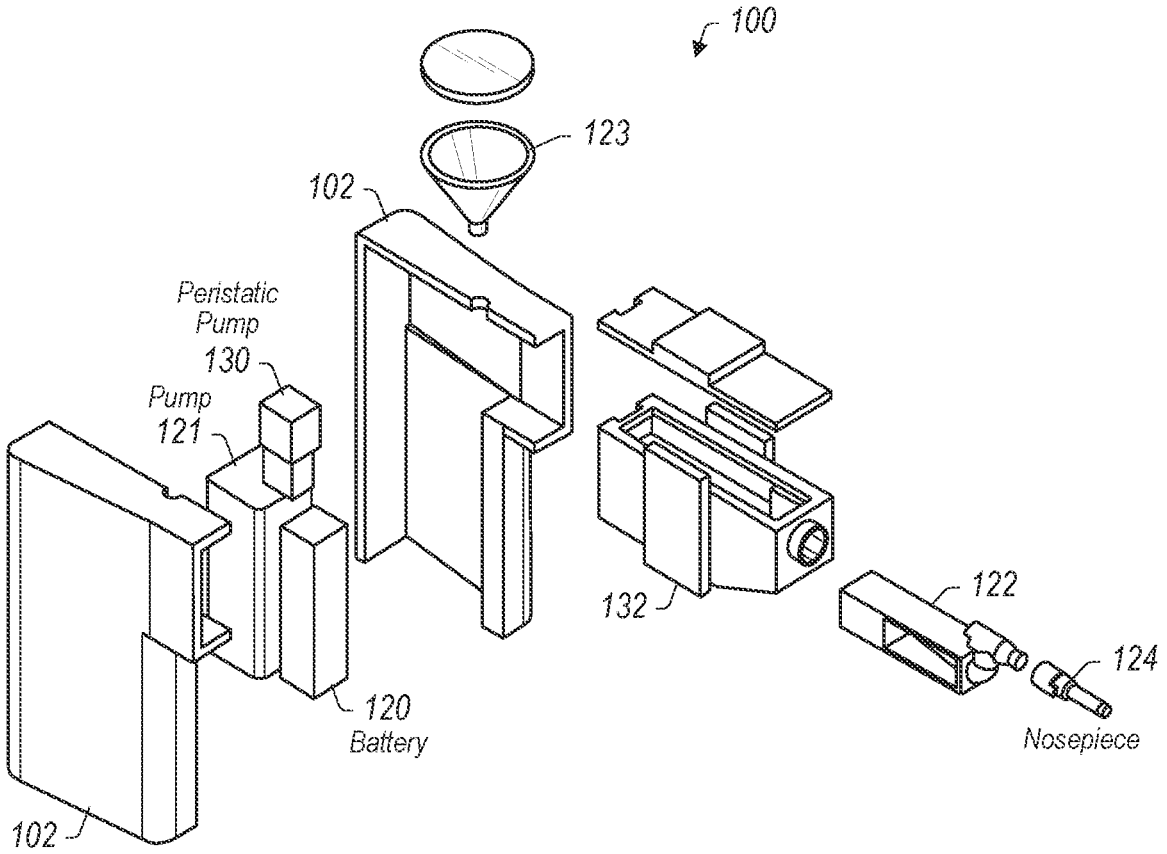
FIG. 2 is an exploded view of the system from FIG. 1.

FIG. 2 is an exploded view of system 100 from FIG. 1. In the illustrated embodiment, internal power source 120 is connected to motors 121. Power source 120 may be, for example, a rechargeable battery. System 100 may also be operated directly plugged into an external outlet (e.g., an AC wall outlet) or an external power source (e.g., a portable battery). In various embodiments, motors 121 include one or more micropumps for generating an air flow. It should be noted that there are no rotating parts in the disclosed embodiment of system 100 and thus there are no high electric fields such as is typically needed in centrifugal and electrospinning methods. The air generated from the air pumps (e.g., motors 121) is channeled through nozzle 122 to accelerate the velocity of the air and reach the speed required when encountering the fluid.

Figure 3:
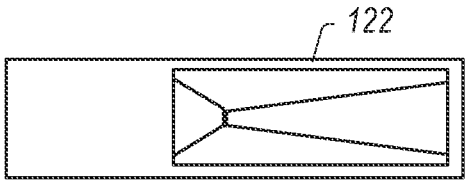
FIG. 3 shows an expanded view of an embodiment of a nozzle with a convergent-divergent design.

In certain embodiments, nozzle 122 is a convergent-divergent (CD) nozzle. FIG. 3 shows an expanded view of an embodiment of nozzle 122 with a convergent-divergent design. Turning back to FIG. 2, the fluid/solution is injected through the external hopper 123, the fluid then going through peristaltic pump 130 to guide the fluid into the manifold 132. The fluid may be, for example, a polymer melt or polymer solution, as described herein. In manifold 132, the fluid is then forced through a pipe or other conduit connected to nosepiece 124. Nosepiece 124 may be, for example, a die nosepiece or an exit die manipulation, as described herein. In the nosepiece 124, the high velocity air is funneled around the exiting polymer solution coming from individual tracks or channels in the nosepiece and then released from the portable system and onto the desired surface. With the air funneled around the polymer solution, the polymer solution exiting the tracks or channels in the nosepiece 124 may form fibers with the shape or size of the fibers determined by the shapes or size of the tracks or channels in the nosepiece/die, as described herein.

Figure 4:
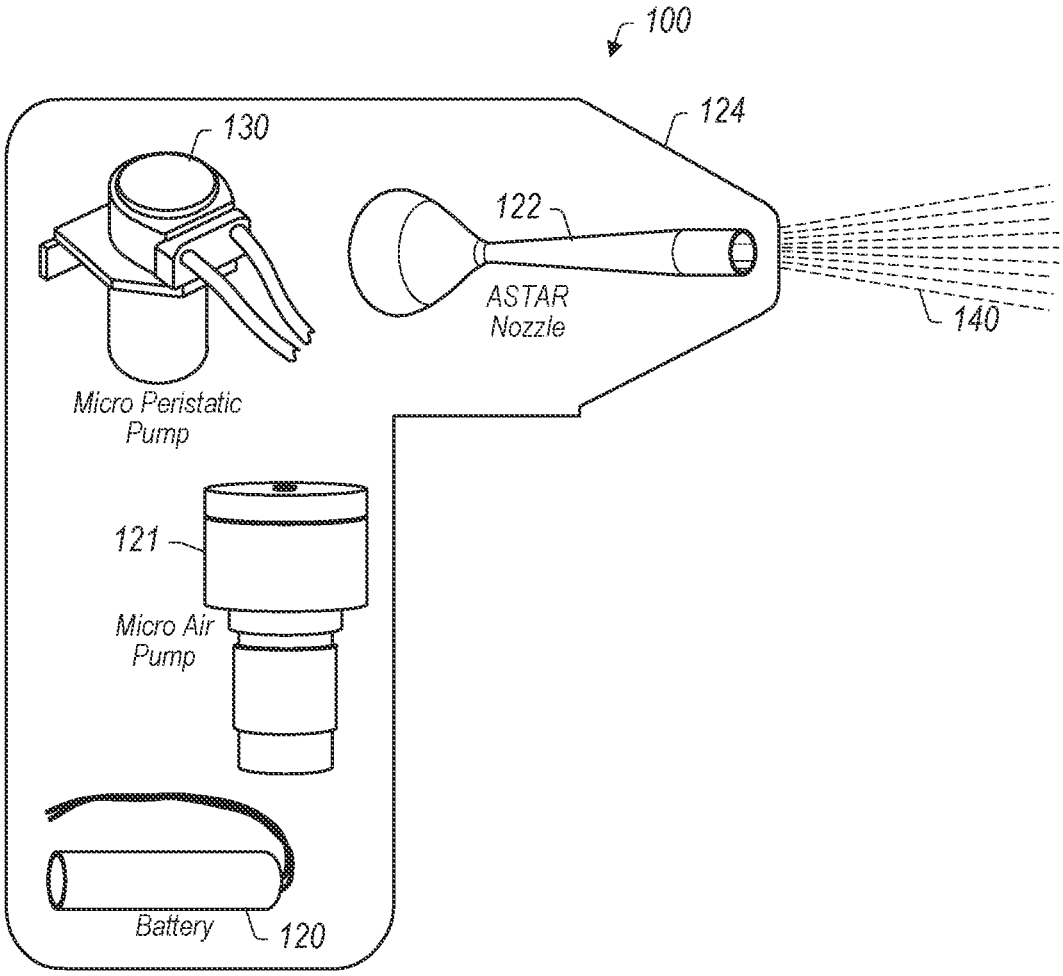
FIG. 4 depicts an illustration of an embodiment of a fiber producing system.

FIG. 4 depicts an illustration of an embodiment of system 100. In the illustrated embodiment, power source 120 is a battery, pump 121 is a micro air pump, and pump 130 is a micro peristaltic pump. Nozzle 122 is a convergent-divergent nozzle (such as an ASTAR nozzle) connected to nosepiece 124. As shown in FIG. 4, fibers 140 are formed as the polymer solution exits nosepiece 124.

As used herein, "fibers" represent a class of materials that are continuous filaments or that are in discrete elongated pieces, similar to lengths of thread. Fibers are of great importance in the biology of both plants and animals, such as for holding tissues together. Human uses for fibers are diverse. For example, fibers may be spun into filaments, thread, string, or rope for any number of uses. Fibers may also be used as a component of composite materials. Fibers may also be matted into sheets to make products such as paper or felt. Fibers are often used in the manufacture of other materials. For instance, a material may be designed to achieve a desired viscosity, or a surfactant may be added to improve flow, or a plasticizer may be added to soften a rigid fiber.

In various embodiments, the polymer solution includes a solvent. As the material is ejected from the nosepiece 124, solvent evaporates leading to solidification of the material into fibers. Non-limiting examples of solvents that may be used include oils, lipids and organic solvents such as DMSO, toluene and alcohols. Water, such as de-ionized water, may also be used as a solvent. For safety purposes, non-flammable solvents are preferred.

The embodiments of methods disclosed herein may be used to create, for example, nanocomposites and functionally graded materials that can be used for fields as diverse as drug delivery, wound healing, and ultrafiltration (such as electrets). In some embodiments, the methods and apparatuses disclosed herein may find application in any industry that utilizes micro- to nano-sized fibers and/or micro- to nano-sized composites. Such industries include, but are not limited to, material engineering, mechanical engineering, military/defense industries, biotechnology, medical devices, tissue engineering industries, food engineering, drug delivery, electrical industries, or in ultrafiltration and/or microelectric mechanical systems (MEMS).

With appropriate exit die manipulation, as described herein, it is possible to form fibers of various configurations, such as continuous, discontinuous, mat, random fibers, unidirectional fibers, woven, and nonwoven. Additionally, various fiber shapes may be formed such as circular, elliptical and rectangular (e.g., ribbon). Other shapes are also possible in contemplated embodiments. The produced fibers may be single lumen or multi-lumen.

By controlling process parameters using system 100, fibers can be made in micron sizes, sub-micron sizes, nano sizes, and combinations thereof. Some variation in diameter and cross-sectional configuration may occur along the length of individual fibers and between fibers but, in general, the fibers created will have a relatively narrow distribution of fiber diameters.

In certain embodiments, the temperature of the chamber (e.g., housing 102) and air are controlled to influence fiber properties. Either resistance heaters or inductance heaters may be used as heat sources to heat the solution and or air stream. Temperatures implemented may have a wide range. For instance, the system may be cooled to as low as −20° C. or heated to as high as 2500° C. Temperatures below and above these exemplary values are also possible. In particular embodiments, the temperature of the system before and/or during spinning is between about 4° C. and about 400° C.

A wide range of volumes/amounts of material may be used to produce fibers due to the use of the peristaltic pump (e.g., pump 130). Pump 130 may be refilled continuously while in operation. The amount of material produced may range from mL to liters (L), or any range derivable therein.

In various embodiments, as described above, nosepiece 124 is a die nosepiece. The die nosepiece may include, for example, passages such as capillaries, slits, nozzles, channels, or tracks that manipulate the exit of polymer solution from the die. In certain embodiments, the die nosepiece includes at least one opening and the material (e.g., polymer solution) is extruded through the opening to create the nanofibers. In some embodiments, the die nosepiece includes multiple openings and the material is extruded through the multiple openings to create the nanofibers. These openings may be of a variety of shapes (e.g., circular, elliptical, rectangular, square) and of a variety of diameter sizes (e.g., 0.01-0.80 mm). When multiple openings are employed, not every opening need be identical to another opening. In certain embodiments, however, every opening is of the same configuration. In some embodiments, one or more openings may include a divider that divides the material as the material passes through the openings. The divided material may form, for example, multi-lumen fibers.

Dies and nozzles, described herein, may be made of a variety of materials or combinations of materials including metals (e.g., brass, aluminum, or stainless steel) or polymers. The choice of material may depend on, for example, the temperature the material is to be heated to, or whether sterile conditions are desired.

In certain embodiments, the material (e.g., solution) used to form the fibers includes at least one polymer. Polymers that may be used include conjugated polymers, biopolymers (for wound care applications), water soluble polymers, and particle infused polymers. Examples of polymers that may be used include, but are not limited to, polypropylenes, polyethylenes, polyolefins, polystyrenes, polyesters, fluorinated polymers (fluoropolymers), polyamides, polyaramids, acrylonitrile butadiene styrene, nylons, polycarbonates, beta-lactams, block copolymers or any combination thereof. The polymer may be a synthetic (man-made) polymer or a natural polymer. The material used to form the fibers may be a composite of different polymers or a composite of a medicinal agent combined with a polymeric carrier. Specific polymers that may be used include, but are not limited to, chitosan, nylon, nylon-6, polybutylene terephthalate (PBT), polyacrylonitrile (PAN), poly(lactic acid) (PLA), poly(lactic-co-glycolic acid) (PLGA), polyglycolic acid (PGA), polyglactin, polycaprolactone (PCL), silk, collagen, poly (methyl methacrylate) (PMMA), polydioxanone, polyphenylene sulfide (PPS); polyethylene terephthalate (PET), polytetrafluoroethylene (PTFE), polyvinylidene fluoride (PVDF), polypropylene (PP), polyethylene oxide (PEO), acrylonitrile butadiene, styrene (ABS), and polyvinylpyrrolidone (PVP).

In some contemplated embodiments, the material used to form the fibers is a metal, a ceramic, or a carbon-based material. Metals employed in fiber creation include, but are not limited to, bismuth, tin, zinc, silver, gold, nickel, aluminum, or combinations thereof. Ceramic material used to form the fibers may include ceramic materials such as alumina, titania, silica, zirconia, or combinations thereof. In some embodiments, the material used to form the fibers may be a composite of different metals (e.g., a bismuth alloy), a metal/ceramic composite, or ceramic oxides (e.g., Vanadium pentoxide, titanium dioxide).

In various embodiments, the fibers created by system 100 are one micron or longer in length. For example, created fibers may be of lengths that range from about 1 μm to about 50 cm, from about 100 μm to about 10 cm, or from about 1 mm to about 3 m. In some embodiments, the fibers may have a narrow length distribution. For example, the length of the fibers may be between about 1 μm to about 9 μm, between about 1 mm to about 9 mm, or between about 1 cm to about 3 cm. In some embodiments, fibers of up to about 10 meters, up to about 5 meters, or up to about 1 meter in length may be formed.

In certain embodiments, the cross-section of the fiber has a particular shape. For instance, the cross-section of the fiber may be circular, elliptical, or rectangular. Other shapes are also possible. The fiber may be a single-lumen fiber or a multi-lumen fiber.

In another contemplated embodiment of a method of creating a fiber, the method includes: spinning material to create the fiber where, as the fiber is being created, the fiber is not subjected to an externally-applied electric field or an externally-applied gas and the fiber does not fall into a liquid after being created.

Embodiments of fibers disclosed herein include a class of materials that exhibit an aspect ratio of at least 100 or higher. The term "microfiber" refers to fibers that have a minimum diameter in the range of 1 micron to 800 nanometers though microfibers may have a minimum diameter in smaller ranges such as 1 micron to 700 nanometers, 10 microns to 700 nanometers, or 5 microns to 800 nanometers. The term "nanofiber" refers to fibers that have a minimum diameter in the range of 1 nanometer to 500 nanometers though smaller ranges are possible, such as 10 nanometers to 250 nanometers or in 20 nanometers to 100 nanometers.

In various embodiments, fibers may include a blending of multiple materials. Fibers may also include holes (e.g., lumen or multi-lumen) or pores. Multi-lumen fibers may be achieved by, for example, designing one or more exit openings in nosepiece 124 to possess concentric openings. In certain embodiments, such openings may include split openings (that is, wherein two or more openings are adjacent to each other; or, stated another way, an opening possesses one or more dividers such that two or more smaller openings are made). Such features may be utilized to attain specific physical properties, such as thermal insulation or impact absorbance (resilience). Nanotubes may also be created using methods and apparatuses described herein.

Fibers produced by system 100 may be analyzed via any means known to those of skill in the art. For example, Scanning Electron Microscopy (SEM) may be used to measure dimensions of a given fiber. For physical and material characterizations, techniques such as differential scanning calorimetry (DSC), thermal analysis (TA) and chromatography may be used.

In one contemplated embodiment, microfibers and nanofibers are produced substantially simultaneously. Any die described herein may be modified such that one or more openings has a diameter and/or shape that produces nanofibers during use, and one or more openings have a diameter and/or shape that produces microfibers during use. Thus, a die, when implemented will eject material to produce microfibers or nanofibers. In some embodiments, nozzles may be designed to create microfibers or nanofibers.

Microfibers and nanofibers produced using any of the devices and methods described herein may be used in a variety of applications. Some general fields of use include, but are not limited to: food, materials, electrical, defense, tissue engineering, biotechnology, medical devices, energy, alternative energy (e.g., solar, wind, nuclear, and hydroelectric energy); therapeutic medicine, drug delivery (e.g., drug solubility improvement, drug encapsulation, etc.); textiles/fabrics, nonwoven materials, filtration (e.g., air, water, fuel, semiconductor, biomedical, etc.); automotive; sports; aeronautics; space; energy transmission; papers; substrates; hygiene; cosmetics; construction; apparel, packaging, geotextiles, thermal and acoustic insulation.

Some products that may be formed using microfibers and/or nanofibers include, but are not limited to: filters using charged nanofiber and/or microfiber polymers to clean fluids; catalytic filters using ceramic nanofibers ("NF"); carbon nanotube ("CNT") infused nanofibers for energy storage; CNT infused/coated NF for electromagnetic shielding; mixed micro and NF for filters and other applications; polyester infused into cotton for denim and other textiles; metallic nanoparticles or other antimicrobial materials infused onto/coated on NF for filters; wound dressing, cell growth substrates or scaffolds; battery separators; charged polymers or other materials for solar energy; NF for use in environmental clean-up; piezoelectric fibers; sutures; chemical sensors; textiles/fabrics that are water & stain resistant, odor resistant, insulating, self-cleaning, penetration resistant, anti-microbial, porous/breathing, tear resistant, and wear resistant; force energy absorbing for personal body protection armor; construction reinforcement materials (e.g., concrete and plastics); carbon fibers; fibers used to toughen outer skins for aerospace applications; tissue engineering substrates utilizing aligned or random fibers; tissue engineering Petri dishes with aligned or random nanofibers; filters used in pharmaceutical manufacturing; filters combining microfiber and nanofiber elements for deep filter functionality; hydrophobic materials such as textiles; selectively absorbent materials such as oil booms; continuous length nanofibers (aspect ratio of more than 1,000 to 1); paints/stains; building products that enhance durability, fire resistance, color retention, porosity, flexibility, antimicrobial, bug resistant, air tightness; adhesives; tapes; epoxies; glues; adsorptive materials; diaper media; mattress covers; acoustic materials; and liquid, gas, chemical, or air filters.

In various embodiments, fibers may be coated after formation. For instance, microfibers and/or nanofibers may be coated with a polymeric or metal coating. Polymeric coatings may be formed by spray coating the produced fibers, or any other method known for forming polymeric coatings. Metal coatings may be formed using a metal deposition process (e.g., CVD).

The principal causes of death among soldiers who die within the first hour after injury are hemorrhage and traumatic brain injury. Thus, there is a need to develop technologies that could promote early intervention in life-threatening injuries. Such new devices/materials must be easily transportable (e.g., compact, lightweight, etc.), easy to use, low maintenance, adaptable to different environments, and should have self-contained power sources as necessary. Embodiments of system 100 described herein are potential devices capable of providing desired early intervention in instances of life-threatening injuries.

In certain embodiments, a hand-held fiber producing device, such as system 100 described herein, may be used to provide fibers to an injury site, to stop hemorrhaging, and promote tissue mending. In various embodiments, an appropriate fiber producing material is loaded into a hand-held fiber producing device, as described above. When an injury occurs, the hand-held fiber producing device may be used to apply fibers (e.g., microfibers and/or nanofibers) to the wound site. The fibers applied to the wound site accelerate the stoppage of blood loss and promote tissue healing. The use of a handheld, portable device which could apply nanofibers in situ to conform to wounds of different geometries (2D and 3D) and therefore provide people with effective treatment to help solve the growing epidemic of chronic wounds is of great benefit.

Figure 5:
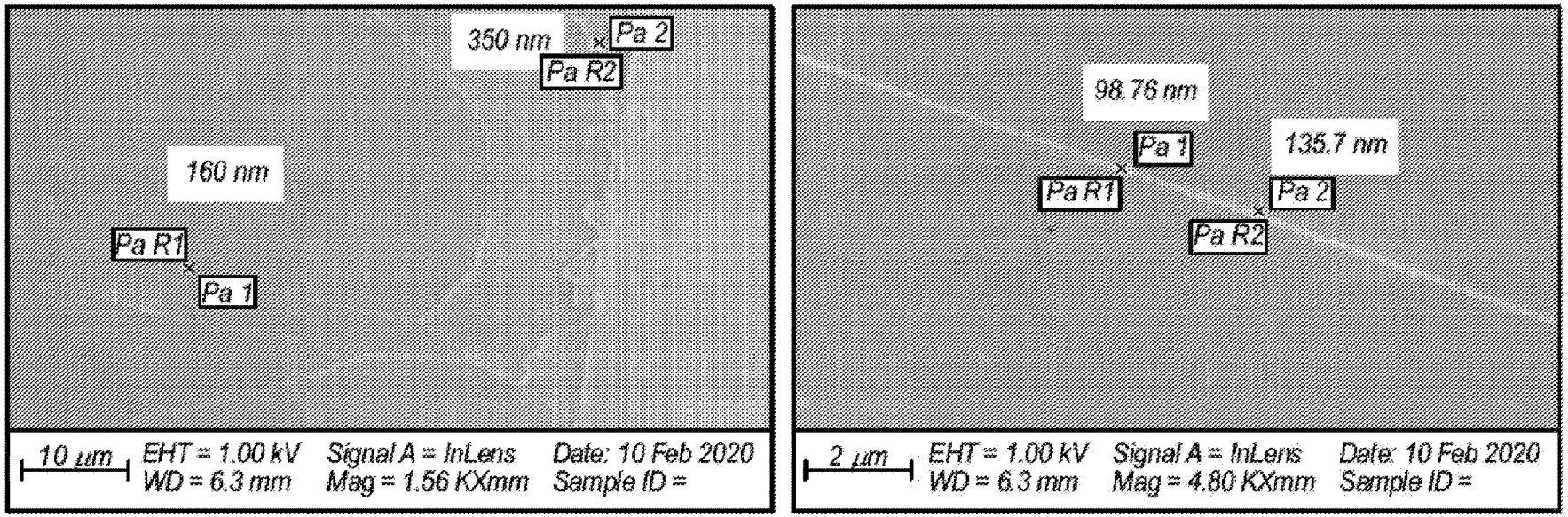
FIG. 5 depicts examples of fibers produced by a fiber producing system with small diameters.

FIG. 5 depicts examples of fibers produced by system 100 with small diameters.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A fiber producing system, the system comprising:

a housing having an inlet and an outlet;

one or more air pumps positioned in the housing;

a peristaltic pump positioned in the housing, the peristaltic pump being coupled to the inlet of the housing for receiving polymer solution into the peristaltic pump;

a manifold positioned at the outlet of the housing, wherein the manifold is coupled to an outlet of the peristaltic pump and an outlet of the one or more air pumps, wherein the manifold includes:

a nozzle coupled to the outlet of the one or more air pumps, wherein the nozzle includes a convergent-shaped portion followed by a divergent-shaped portion to increase a velocity of air exiting an outlet of the nozzle; and a nosepiece coupled to the outlet of the nozzle, the nosepiece including a die with one or more individual passages for flow of the polymer solution from the outlet of the peristaltic pump and wherein, in the manifold, a flow of the air from the nozzle around the die and the one or more passages such that the air is being funneled around the polymer solution as the polymer solution exits the passages and moves the polymer solution out of the one or more passages to form fibers as the polymer solution exits the one or more passages and the nosepiece.

2. The system of claim 1, wherein the housing is a molded housing.

3. The system of claim 1, wherein the nozzle and the manifold are positioned in the housing.

4. The system of claim 1, wherein the housing includes a handle.

5. The system of claim 1, further comprising a hopper coupled to the peristaltic pump.

6. The system of claim 5, wherein the hopper is configured to provide the polymer solution to the peristaltic pump.

7. The system of claim 1, wherein the peristaltic pump is configured to move the polymer solution into the manifold.

8. The system of claim 1, wherein the one or more passages are configured to extrude the polymer solution to form fibers during use.

9. The system of claim 1, wherein at least one of the one or more passages has a shape and size configured to provide fibers of a desired shape and size.

10. The system of claim 1, further comprising a divider in at least one of the one or more passages to divide the polymer solution and form multi-lumen fibers.

11. The system of claim 1, further comprising a portable power source coupled to the pumps.

12. A method of making fibers, comprising:

providing a polymer solution to a peristaltic pump positioned in a housing;

generating a flow of air in the housing using an air pump positioned in the housing;

moving, using the peristaltic pump, the polymer solution into a nosepiece in a manifold in the housing, wherein the nosepiece includes a die having one or more passages;

moving, using the air pump, air into and through a nozzle in the manifold, wherein the nozzle includes a convergent-shaped portion followed by a divergent-shaped portion that increases a velocity of the air exiting the nozzle;

and funneling the air exiting the nozzle around the die and the one or more passages such that the air with the increased velocity funnels around the polymer solution as the polymer solution exits the one or more passages and moves the polymer solution out of the one or more passages to form fibers as the polymer solution exits the one or more passages and the nosepiece.

13. The method of claim 12, wherein the fibers have a shape and size determined by a shape and size of the one or more passages in the nosepiece.

14. The method of claim 12, wherein the fibers have a length greater than 1 micron.

15. The method of claim 12, further comprising extruding the polymer solution through the one or more passages to produce the fibers.

16. The method of claim 12, wherein providing the polymer solution include providing the polymer solution to a hopper coupled to the peristaltic pump.

17. The method of claim 12, further comprising providing the fibers onto a surface.

18. The method of claim 12, further comprising controlling a temperature of the housing to control one or more properties of the fibers.

19. The method of claim 18, further comprising controlling the temperature using a heater positioned in the housing.

* * * * *